United States Patent [19]

Brittain et al.

[11] Patent Number: 4,834,604

[45] Date of Patent: May 30, 1989

[54] PIPE MOVING APPARATUS AND METHOD

[75] Inventors: John C. Brittain; Cecil Jenkins, both of Tulsa; William P. Adelman, Sapulpa; Joseph R. Woolslayer, Tulsa, all of Okla.

[73] Assignee: Lee C. Moore Corporation, Tulsa, Okla.

[21] Appl. No.: 110,465

[22] Filed: Oct. 19, 1987

[51] Int. Cl.[4] ..... E21B 19/14

[52] U.S. Cl. ..... 414/22.55; 175/85; 294/81.21; 294/81.61; 414/786

[58] Field of Search ..... 414/22, 745, 786, 22.54, 414/22.55, 22.62, 22.71; 175/52, 85; 294/81.21, 81.61

[56] References Cited

U.S. PATENT DOCUMENTS

| | | | |
|---|---|---|---|
| Re. 26,284 | 10/1967 | O'Neill et al. | 175/57 |
| 3,177,044 | 4/1965 | Knights | 414/22 X |
| 3,194,313 | 7/1965 | Fanshawe | 414/22 X |
| 3,212,593 | 10/1965 | Reischl . | |
| 3,280,920 | 10/1966 | Scott | 414/22 X |
| 3,464,507 | 9/1969 | Alexander et al. | 414/22 X |
| 3,561,811 | 2/1971 | Turner | 414/22 X |
| 3,613,905 | 10/1971 | Woolslayer et al. . | |
| 3,633,771 | 1/1972 | Woolslayer et al. | 414/22 |
| 3,682,259 | 8/1972 | Cintract et al. | 175/85 |
| 3,696,944 | 10/1972 | Campbell . | |
| 3,701,435 | 10/1972 | Woolslayer et al. . | |
| 3,702,640 | 11/1972 | Cintract et al. | 175/85 |
| 3,716,155 | 2/1973 | Woolslayer et al. . | |
| 3,815,757 | 6/1974 | Woolslayer . | |
| 3,860,122 | 1/1975 | Cernosek . | |
| 3,887,086 | 6/1975 | Woolslayer et al. | 414/22 |
| 3,978,993 | 9/1976 | Howard | 414/22 |
| 3,978,994 | 9/1976 | Woolslayer et al. . | |
| 3,986,618 | 10/1976 | Woolslayer et al. . | |
| 3,986,619 | 10/1976 | Woolslayer et al. | 414/22 |
| 3,991,887 | 11/1976 | Trout | 414/22 |
| 4,061,233 | 12/1977 | Benjamin . | |
| 4,163,625 | 8/1979 | Jenkins | 414/22 |
| 4,172,684 | 10/1979 | Jenkins | 414/22 |
| 4,440,220 | 4/1984 | McArthur | 175/85 X |
| 4,455,116 | 6/1984 | Lindstedt et al. | 414/22 |
| 4,501,524 | 2/1985 | Yoan et al. | 414/22 |
| 4,718,805 | 1/1988 | Becker | 414/22 |

OTHER PUBLICATIONS

Lee C. Moore Drawing No. JA61667-A.

*Primary Examiner*—Leslie J. Paperner

*Attorney, Agent, or Firm*—Laney, Dougherty, Hessin & Beavers

[57] ABSTRACT

Machine for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, an hydraulic ram on the strongback is actuated thereby lowering the pipe or casing onto the string suspended in the well bore and the additional pipe or casing joint is threaded thereto.

13 Claims, 7 Drawing Sheets

18
44
13
38
51
50
16
22
24
26
10
14
42
30
34
40
36
32
20
12

PIPE MOVING APPARATUS AND METHOD

BACKGROUND OF THE INVENTION

The instant invention pertains to methods and apparatus for moving pipe and more particularly to such a method and apparatus in which pipe or casing is moved from a horizontal position adjacent a well to a vertical position over the well bore.

In drilling an oil or gas well, drill pipe is typically stacked on racks in a horizontal position adjacent a drilling rig platform. One method for transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent the rotary table which supports the pipe temporarily. When it is necessary to add the pipe to the drill string, slips are secured about the drill string on the rotary table thereby supporting the same in the well bore. The pipe is disconnected from the traveling equipment and the elevators or the kelly are connected to the pipe in the mousehole. Next, the traveling block is raised thereby positioning the pipe over the drill string and tongs are used to secure the pipe to the upper end of the drill string. The drill pipe elevators suspend the drill pipe from a collar which is formed around one end of the pipe and do not clamp the pipe thereby permitting rotational pipe movement in order to threadably engage the same to the drill string.

There exist prior art apparatus for gripping a drill pipe on a pipe rack for moving the same into vertical alignment with a drill string suspended by slips from the rotary table. For example, U.S. Pat. No. 3,633,771 to Woolslayer et al. discloses an apparatus for moving drill pipe into and out of an oil well derrick. In Woolslayer, a stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevators suspended from the traveling block.

A prior art technique for moving joints of casing from racks adjacent the drilling rig comprises tying a line from the rig onto one end of a selected casing joint on the rack. The line is raised thereby lifting the casing joint up a ramp leading to the rig platform. As the rope lifts the casing from the ramp, the lower end of the casing swings across the platform in a dangerous manner. The danger increases when a floating system is used in connection with offshore drilling. Since the rope is tied around the casing at one end thereof, the casing does not hang vertically but rather tilts somewhat. A man working on a platform elevated above the rig floor must hold the top of the casing and straighten it out while the casing is threaded onto the casing string which is suspended in the well bore by slips positioned on the rotary table.

It can be seen that it would be desirable to be able to grip casing or pipe positioned on a rack adjacent a drilling well, move the same into vertical orientation over the well bore and thereafter lower the same onto the string suspended in the well bore. It would also be desirable to utilize such a method and apparatus for transferring pipe from a rack adjacent the well to the mousehole on the rig platform during drilling. With respect to drill pipe, it would be desirable to have such a method and apparatus in which pipe could be transferred from the platform to the pipe rack.

SUMMARY OF THE INVENTION

The instant invention comprises apparatus for moving pipe between a horizontal position adjacent a well to a vertical position over the well bore. A boom is pivotally attached to a base fixed adjacent the well. The boom may be pivoted substantially within a vertical plane toward and away from the well bore. Gripping means are mounted on the outer end of the boom for gripping a pipe. Means are provided for orienting a pipe so gripped along a vertical axis as the boom is swung toward the well bore. Means for vertically shifting pipe is operatively connected to the gripping means.

The apparatus of the invention performs the method of the invention. It is to be appreciated that as used herein the term "pipe" encompasses any elongate element which is to be lowered into a well bore.

Numerous advantages obtained by the instant invention will become apparent to a person having ordinary skill in the art when the following detailed description is read in view of the accompanying drawings.

DETAILED DESCRIPTION OF THE PREFERRED EMBODIMENTS OF THE INVENTION

Figure 1:
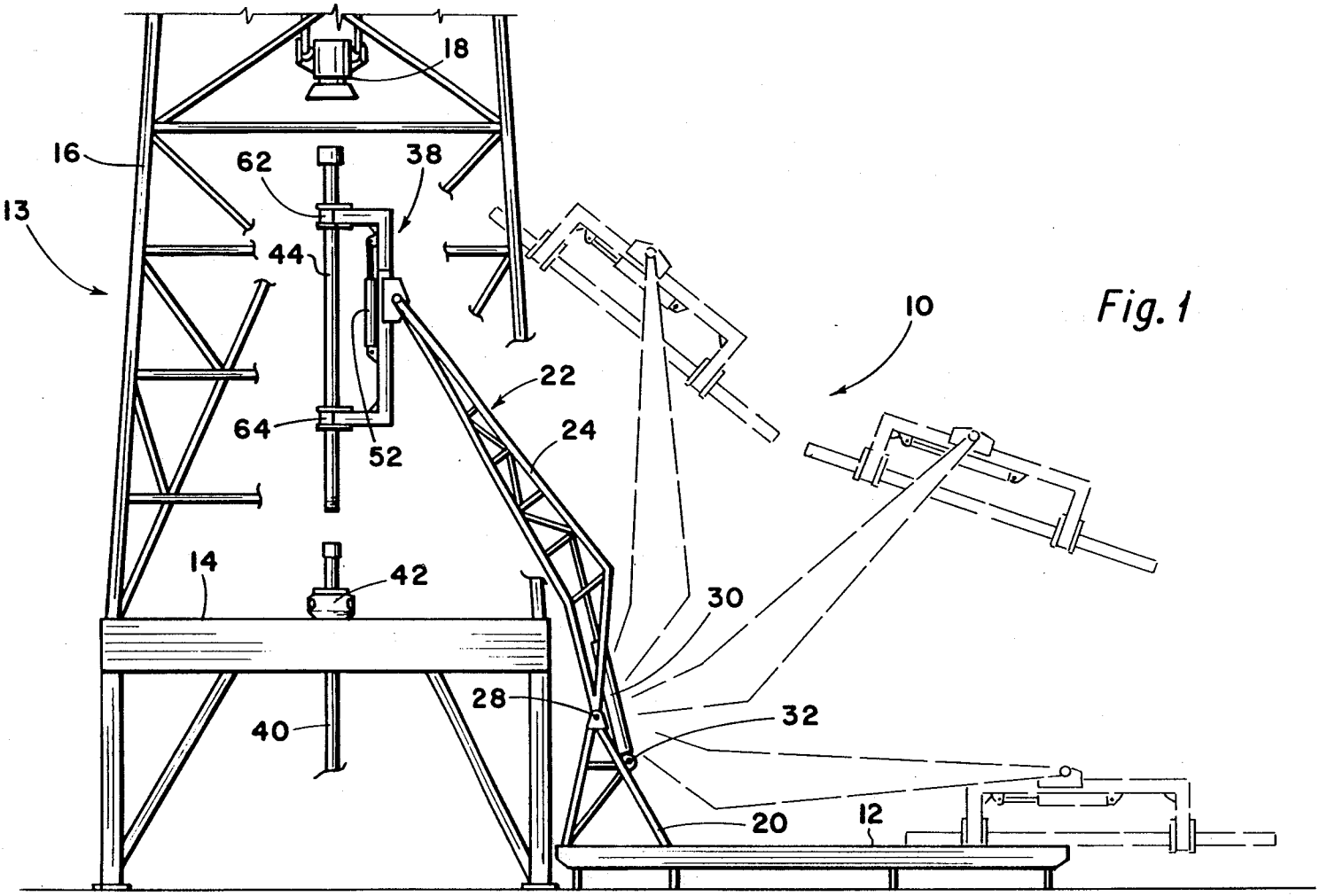
FIG. 1 is a fragmentary side view of a drilling rig showing a first embodiment of the invention in an upper position in solid lines with other positions shown in dashed lines.
Figure 2:
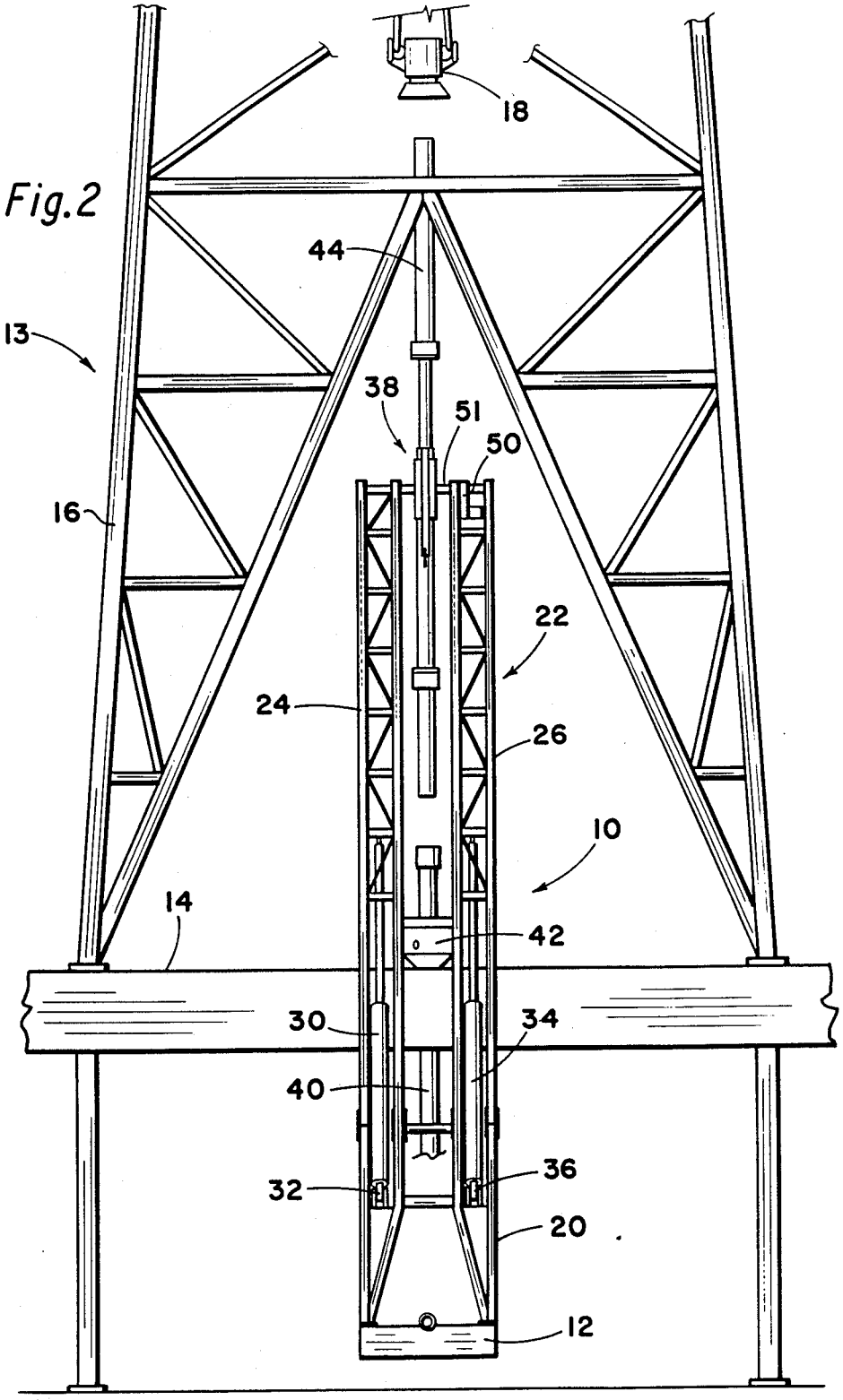
FIG. 2 is a front view as seen from the right-hand side of FIG. 1.

Referring to FIGS. 1 and 2, indicated generally at 10 is a casing handling machine constructed in accordance with the instant invention. Machine 10 includes an elongate base 12 which rests on the ground adjacent a drilling rig indicated generally at 13. In offshore applications, the machine may be positioned adjacent a drilling rig on a floating system. Drilling rig 13 includes a platform 14 having a derrick 16 (or mast) mounted thereon. The derrick is fragmented in the view of FIG. 1 to afford a complete side view of machine 10.

A set of conventional casing elevators 18 is suspended from the traveling block (not shown) which in turn is suspended from the crown block (also not shown) at the top of the derrick.

Machine 10 includes therein a pedestal 20 which is fixedly secured to base 12. A bifurcated boom 22 includes a first arm 24 and a second arm 26. The boom is pivotally attached via a connection 28 to the top of pedestal 20. A conventional ram 30 has one end pivotally connected to pedestal 20 via connection 32 and the other end pivotally connected to boom arm 24. A similar ram 34 (visible in FIG. 2) is connected to pedestal 20 via pivotal connection 36 and is pivotally connected at the other end thereof to boom arm 26.

Indicated generally at 38 is a strongback which is mounted on the end of boom 22 between boom arms 24, 26. Before directing attention to FIGS. 3 and 4 for more detailed description of strongback 38, consideration will be given to the remainder of the structure associated with the drilling rig. A casing string 40 extends downwardly into the well bore (not shown). A set of slips 42 is supported by the rotary table on platform 14. The slips grip the upper end of casing string 40 and thereby suspend the same in the well bore. A single casing joint 44 is held by strongback 38.

Figure 3:
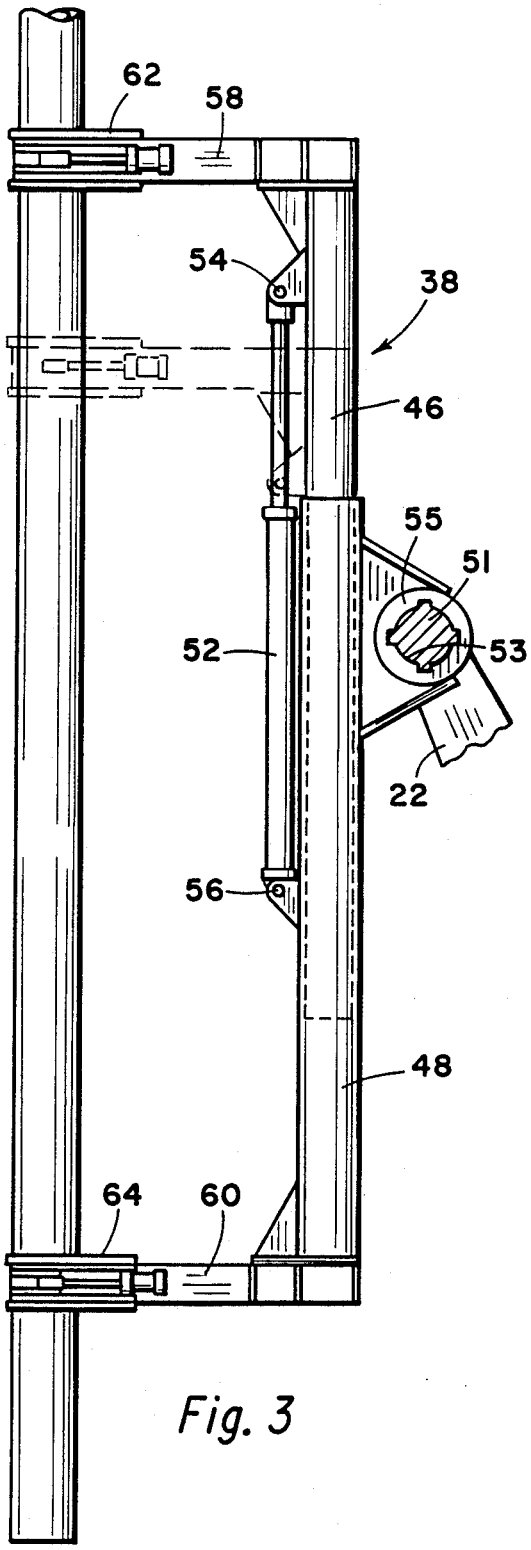
FIG. 3 is an enlarged view of a portion of the embodiment shown in FIGS. 1 and 2.
Figure 4:
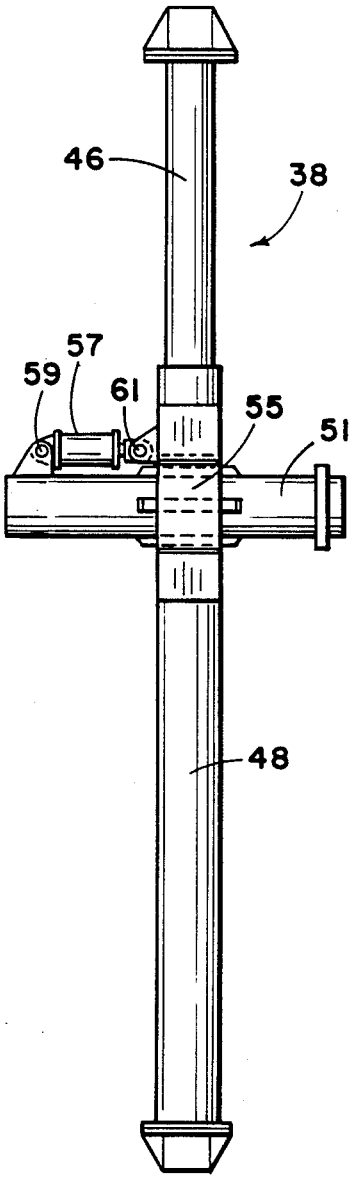
FIG. 4 is a right-hand side view of that portion of the embodiment shown in FIG. 3.

Turning now to FIGS. 3 and 4, strongback 38 includes therein a telescoping member 46 which is axially slidable within a telescoping member 48. The lower portion of member 46 is received within member 48 is shown in dashed lines in FIG. 3. Members 46, 48 are also referred to herein as elements. A commercially available rotary actuator 50 (in FIG. 2) is mounted on the upper end of boom arm 26. The actuator includes a circular housing in which there is a vane (not shown) that is secured to a shaft (not visible) which is connected to the end of a splined shaft 51 (in FIGS. 2, 3 and 4) which extends laterally from strongback 38. By delivering fluid pressure to the housing at one side or the other of the vane, the shaft can be rotated in either direction. By controlling the delivery of fluid to the actuator, the strongback can be maintained at the correct angle to the ground as it is raised and lowered, as will hereinafter be more fully explained in connection with the description of the operation of the instant embodiment of the invention.

Splined shaft 51 is received in a splined bore 53 which is defined in a cylindrical fitting 55. Fitting 55 is fixedly mounted on telescoping member 48. A linear actuator or ram 57 has one end mounted on shaft 51 via connector 59 and the other end mounted on strongback 38 via connector 61. As will later be more fully explained, actuation of ram 57 moves the strongback laterally relative to shaft 51.

A linear actuator or ram 52 has one end connected to member 46 via connection 54 and the other end to member 48 via connection 56. It can be seen that contracting ram 52 causes member 46 to be further received within member 48 and extending the ram withdraws member 46 from member 48. Ram 52 is referred to herein as means for contracting and extending.

An upper jaw mounting arm 58 is fixedly connected to the upper end of member 46 and extends laterally therefrom. In a similar fashion, a lower jaw mounting arm 60 is fixedly mounted on the lower end of member 48 and extends laterally therefrom. A pair of hydraulically operated gripping jaws 62, 64 are mounted on arms 58, 60, respectively. Gripping jaws 62, 64 are also referred to herein as pipe gripping means and clamps. By selectively varying the flow of hydraulic fluid to each of the gripping jaws, the jaws may be made to fixedly clamp casing 44 or to loosely restrain the same thereby permitting rotational movement of casing 44 and/or movement along the longitudinal axis of the casing joint relative to the jaw in which it is restrained.

Considering now the operation of the embodiment of FIGS. 1–4, in FIG. 1, casing joint 44 is initially received in a horizontal position on a pipe rack (not shown) adjacent base 12. The joint is then rolled onto base 12. Rams 30, 34 are contracted thereby moving boom 22 to the lowermost position as shown in dashed lines in FIG. 1. Gripping jaws 62, 64 are then contracted to grip casing joint 44. Rams 30, 34 are extended thus moving boom 22 through an arc to its final position over casing string 40. As the boom so moves, the strongback rotates in a clockwise direction. It continues to rotate in this same fashion from the dashed line lower position to the solid line position in FIG. 1.

It is to be appreciated that a person having ordinary skill in the art can design and build a hydraulic control circuit which will permit extension and contraction of rams 30, 34 while rotating the hydraulic actuator to achieve strongback rotation as described.

When casing joint 44 is positioned in the solid line position as shown in FIG. 1, jaws 64 are adjusted to loosely restrain casing 44. Thereafter, ram 52 on the strongback is contracted thereby moving casing joint 44 vertically downward to the top of casing string 40. If it is necessary, joint 44 may be axially aligned with casing string 40 by using rotary actuator 50, which pivots strongback 38 about the axis of shaft 51 thereby pivoting joint 44 about the lower end thereof. Ram 57, which moves strongback 38 parallel to the axis of shaft 51 may also be used to pivot joint 44 about the lower end thereof. With jaws 64 loosely restraining the lower end of joint 44, rotary actuator 50 and ram 57 may thus be used to pivot joint 44 about the lower end thereof in any direction in order to align joint 44 with the casing string.

Boom 22 may also be moved as described to align joint 44 with casing string 40. When the threads on the lower end of casing joint 44 are received in the upper female threaded collar of the casing string, jaws 62 are adjusted so as to restrain joint 44 while enabling rotational movement thereof. Next, the usual tongs (not shown) are used to rotate casing joint 44 thereby connecting the same to the casing string. Elevators 18 are then lowered to grip the upper end of casing joint 44. Next, slips 42 are removed, jaws 62, 64 are completely opened and cylinders 30, 34 contracted thus causing the boom to move to its lowermost position to grip the next casing joint which is positioned on base 12. As machine 10 returns to the lowermost position thereof, strongback 38 rotates in a counterclockwise direction to reassume the position shown in dashed lines in FIG. 1. The casing string is then lowered by the traveling block until the upper end of casing joint 44 is in the position shown for the upper end of casing string 40 in FIG. 1. Slips 42 are then enclosed about the upper end of casing joint 44, elevators 18 are removed and boom 22 is raised with the next casing joint to be connected to the casing string.

It is to be appreciated that this same technique may be used to add drill pipe or drill collars to a drilling string in the same manner as the above-described method for running casing into the well bore.

In the same manner, the process can be reversed to remove drill pipe from the well bore. That is, when the elevators are raised with the drill string suspended therefrom, slips may be placed around the drill string and jaws 62, 64 can be made to loosely restrain the upper section of drill pipe. The same can then be unthreaded from the drill string, the clamps made to securely grip the drill pipe and the same carried down to a horizontal position on base 12 from which it can be easily rolled onto adjacent racks.

Figure 5:
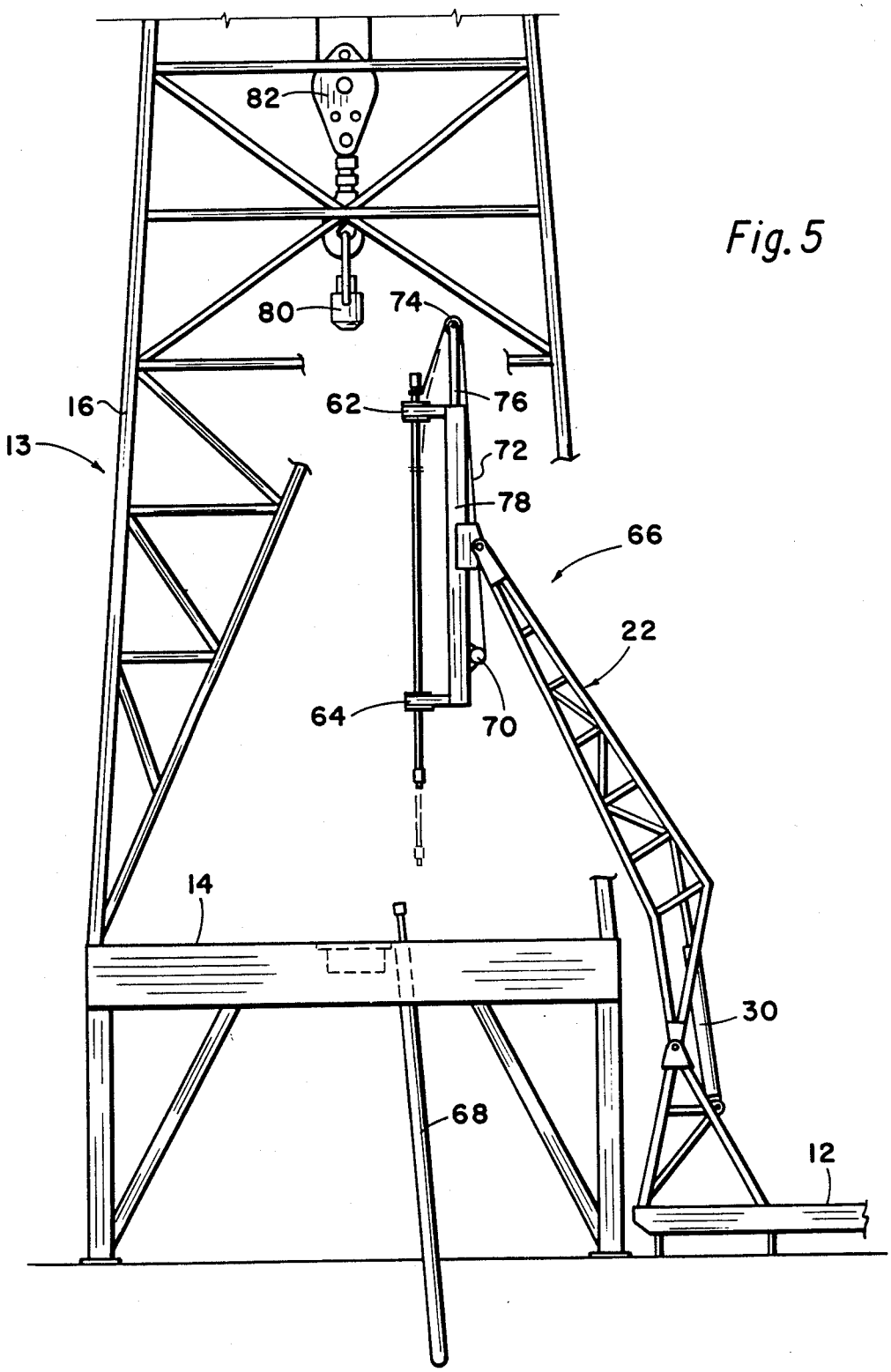
FIG. 5 is a view similar to FIG. 1 showing a second embodiment of the invention.
Figure 6:
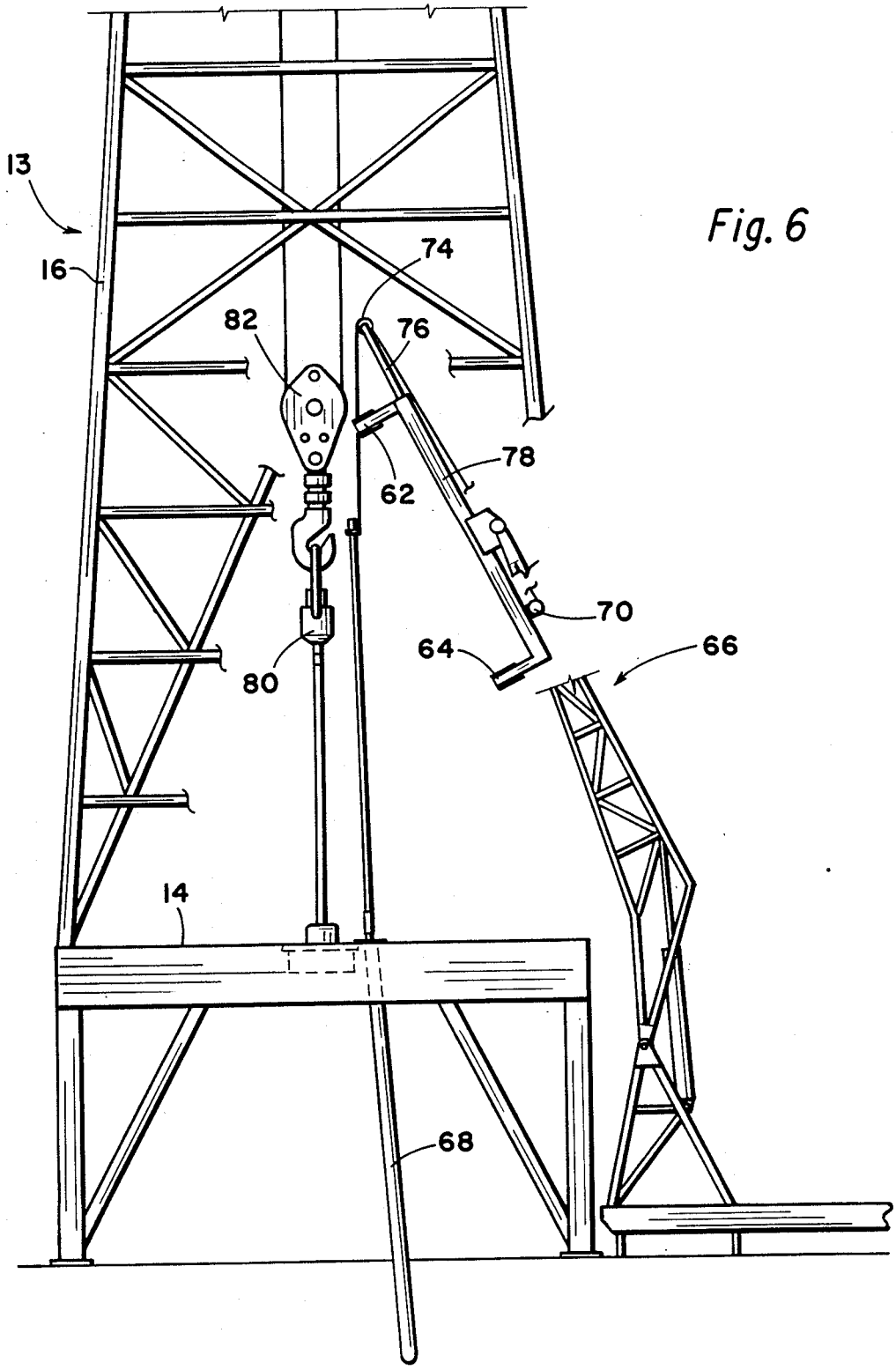
FIG. 6 is a view similar to FIG. 5 showing a shift in the position of the apparatus.

Turning now to FIGS. 5 and 6 indicated generally at 66 is a second machine constructed in accordance with the instant invention. Certain of the parts on machine 66 correspond to those previously described for machine 10 and have been identified with the same numeral. Machine 66 may be used to provide drill pipe to a mousehole scabbard 68 during drilling. The strongback of machine 66 as shown does not include telescoping members and therefore, of course, does not include a ram corresponding to ram 52. Included on the strongback of machine 66 is a commercially available winch 70 which is mounted on the lower end thereof opposite jaws 62, 64. A line 72 from the winch extends over a sheave 74 which is journalled on a fixed post 76 extending upwardly from a rigid strongback member 78. Although machine 66 as shown does not include telescoping members it is to be appreciated that a machine incorporating both the strongback of machine 10 and the winch of machine 66 falls within the teachings of the invention.

As shown in FIGS. 5 and 6, drill pipe elevators 80 are suspended from traveling block 82 which in turn is suspended from the crown block (not shown) at the top of derrick 16.

Considering now the operation of the embodiment of FIGS. 5 and 6, machine 66 may be used to grip a section of drill pipe which is positioned on a horizontal rack in the same fashion as the casing in FIG. 1. When jaws 62, 64 grip the drill pipe, line 72 is secured around the upper end thereof as shown in FIGS. 5 and 6. Thereafter, rams 30, 34 are extended and the strong back rotates in the same fashion for machine 66 as for machine 10 when boom 22 moves from its lowermost position to its upper position as shown in FIG. 5. After machine 66 is in the configuration of FIG. 5, jaws 62, 64 are opened and strong back 78 is pivoted about the shaft, like shaft 51 in machine 10, which support strongback member 78. Such rotation may be effected by applying hydraulic fluid in an appropriate manner to the rotary actuator. If necessary for alignment, lateral strong-back movement is effected in the same manner as for machine 10. After the strongback is so pivoted to the position of FIG. 6, winch 70 may be operated thereby lowering the drill pipe and the same may be received in scabbard 68 or as shown in FIG. 6 an upper length of pipe may be threaded to a pipe already received in mousehole scabbard 68.

Thereafter, elevators 80 may remove the drill pipe from the mousehole scabbard, swing the same over the drill string which is secured by slips and connect the drill pipe suspended from the elevators to the drill string in the usual manner.

Figure 7:
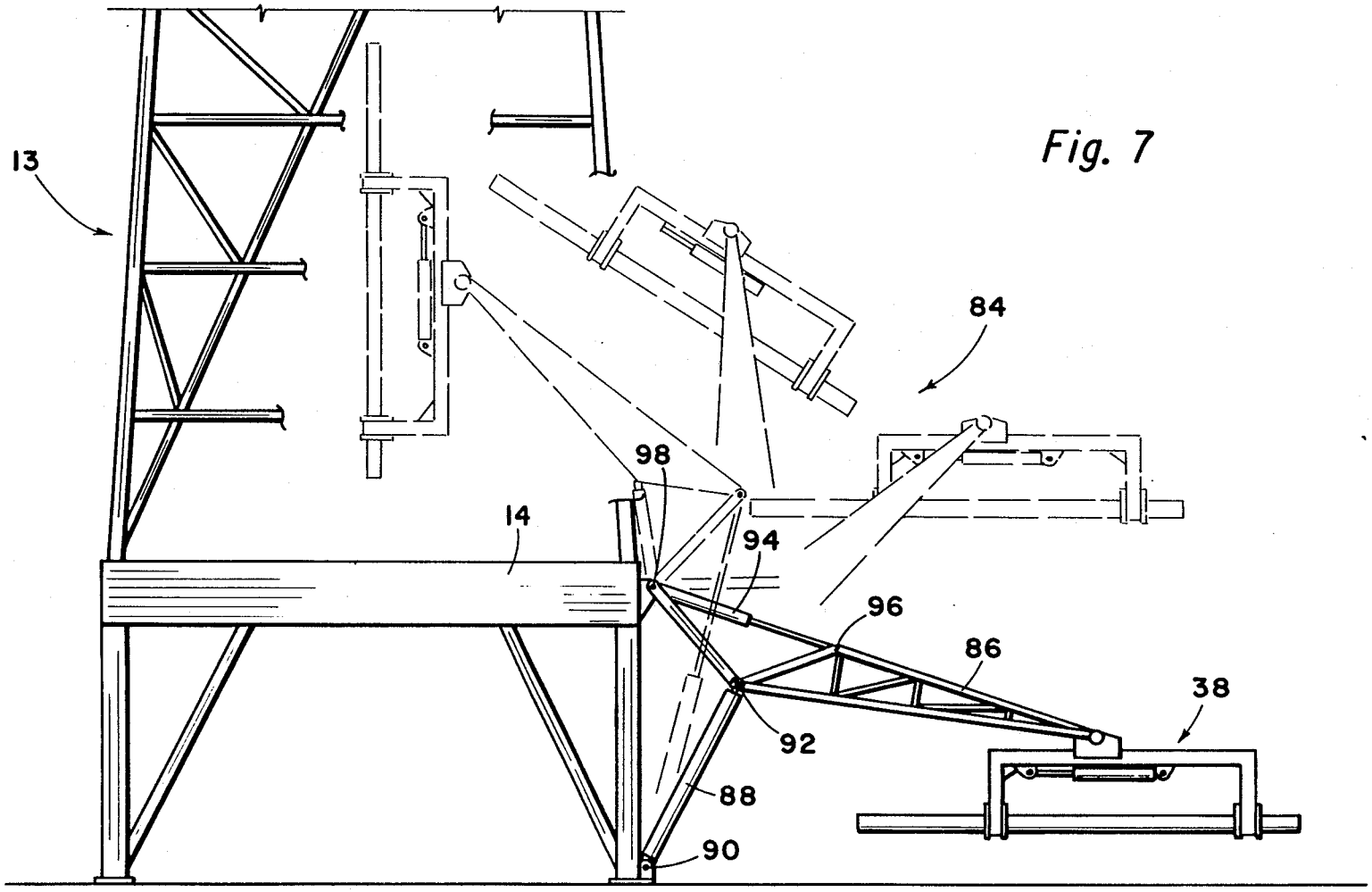
FIG. 7 is a view similar to FIG. 1 of a third embodiment of the invention in a lower position in solid lines with other positions shown in dashed lines.
Figure 8:
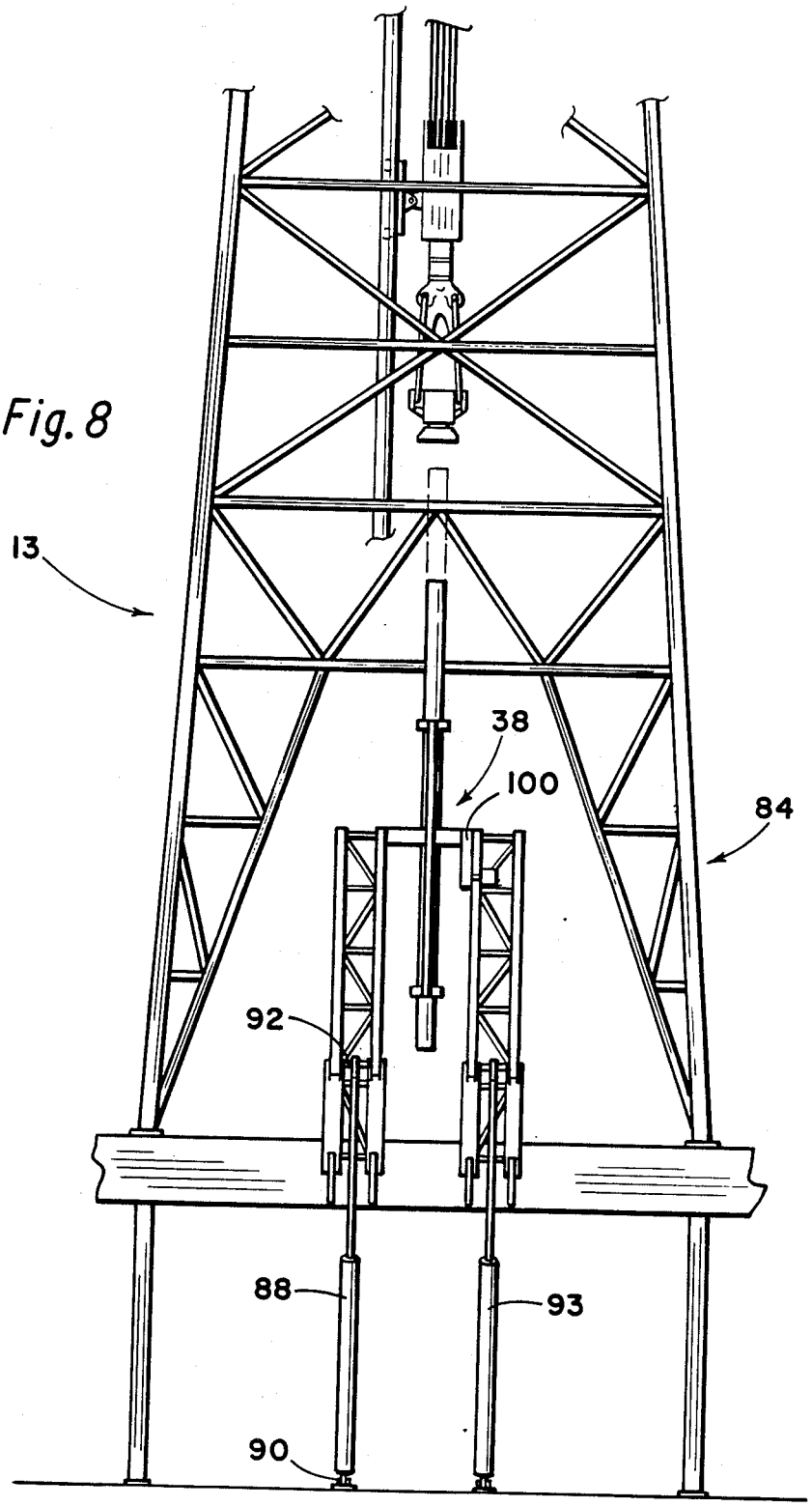
FIG. 8 is a front view as seen from the right-hand side of FIG. 7.

Turning now to FIGS. 7 and 8, indicated generally at 84 is a third machine constructed in accordance with the instant invention. Machine 84 includes a strongback 38 which is substantially identical to the strongback of machine 10. The principal difference between machine 84 and machine 10 is that machine 84 is mounted on drilling rig 13 which serves as a base for machine 84. Machine 84 includes a bifurcated boom 86. A first ram 88 has one end pivotally connected to the lower end of the drilling rig platform via connection 90 and the other end pivotally connected to the boom via connection 92. A second ram 93 is mounted to the other arm of boom 86 opposite ram 88. A third ram 94 has one end pivotally connected to boom 86 via connection 96 and the other end pivotally connected to platform 14 via connection 98. A fourth ram (not visible) is positioned opposite ram 94 and is connected between the boom and the platform in a similar manner. A rotary actuator 100 (in FIG. 8) causes strongback pivoting relative to the boom in the same fashion as the rotary actuator on machine 10.

In moving pipe or casing between a horizontal position and a vertical position over the well bore, machine 84 operates in substantially the same manner as machine 10; however, the manner in which the boom is raised or lowered by rams 88, 94 is different.

In order to raise boom 86 from the solid line position of FIG. 7, rams 88 and 93 are extended while ram 94, and its opposed ram (not visible), are contracted thus moving the boom and strongback through the dashed line positions shown in FIG. 7 and ultimately positioning the casing or pipe in a vertical orientation over the well bore as shown. The boom may be lowered by reversing this process, i.e., ram 94 is gradually extended while ram 88 is contracted thus moving the boom from its upper position, shown in dashed lines, through the other dashed line positions to the lowermost solid line position.

It is to be appreciated that additions and modifications may be made to the instant embodiment of the invention without departing from the spirit thereof which is defined in the following claims.

What is claimed is:

1. Apparatus for moving pipe between a horizontal position adjacent a well to a position over the well bore, said apparatus comprising:

a base fixed adjacent the well;

a boom pivotally attached to said base for swinging toward and away from the well bore in a substantially vertical plane;

a telescoping strongback rotatingly mounted on said boom, said strongback further comprising:

a first elongate telescoping member, a second elongate telescoping member having a lower portion received and axially slidable within said first telescoping member, first pipe gripping means mounted on said first telescoping member for releasably gripping a pipe, and second pipe gripping means mounted on said second telescoping member for releasably gripping such pipe;

means for rotating said strongback in order to orient such pipe substantially along the well axis when said boom is swung toward the well bore; and means for shifting such pipe along the well axis after said boom is swung toward the well bore, said shifting means being operatively connected to said first and second telescoping members for contracting and extending said second telescoping member.

2. The apparatus of claim 1 wherein said rotating means comprises a rotary actuator operatively connected between said boom and said strongback.

3. The apparatus of claim 2 further comprising:

means for moving said strongback laterally relative to the longitudinal axis of said boom.

4. The apparatus of claim 2 wherein said first pipe gripping means is constructed and arranged to restrain such pipe received therein while permitting movement of such pipe along the longitudinal axis thereof.

5. The apparatus of claim 1 wherein said shifting means comprises:

a linear actuator having one end thereof connected to said first telescoping member and another end thereof connected to said second telescoping member.

6. The apparatus of claim 1 wherein said first and second gripping means are constructed and arranged to permit rotation of such pipe joint received therein while maintaining the joint in a position substantially axially aligned with the well bore.

7. A telescoping strongback comprising:

a first elongate telescoping member;

a second elongate telescoping member having a lower portion received and axially slidable within said first telescoping member;

first pipe gripping means mounted on said first telescoping member for releasably gripping a pipe, said first gripping means being constructed and arranged to restrain such pipe received therein while permitting movement of such pipe along the longitudinal axis thereof;

second pipe gripping means mounted on said second telescoping member for releasably gripping such pipe; and means attached to said first telescoping member for rotatingly mounted said strongback on a boom.

8. The strongback of claim 7 further comprising:

a linear actuator having one end connected to said first telescoping member and the other end thereof connected to said second telescoping member.

9. A method for using a pipe moving machine of the type having a pair of pipe gripping jaws mounted on a telescopic strongback, said method comprising the steps of:

positioning a pipe joint horizontally on a rack adjacent a well;

positioning the strongback over the pipe joint;

using the jaws to grip the pipe joint;

lifting the gripped pipe joint and rotating the strongback so that the pipe joint is positioned above a pipe string suspended in the well bore;

lowering the joint until the lower end thereof is adjacent the upper end of the pipe string, the joint being lowered by axially sliding a first telescoping member of the telescoping strongback within a second telescoping member of the strongback;

adjusting the gripping jaws to a position permitting the pipe joint to be rotated above the longitudinal axis thereof while maintaining the pipe in a position substantially axially aligned with the pipe string;

rotating the pipe joint to threadably connect it to the upper end of the string; and releasing the gripping jaws.

10. The method of claim 9 wherein said method further includes the steps of laterally shifting the gripped pipe relative to the well axis prior to the step of rotating the pipe to threadably connect it to the upper end of the pipe string.

11. A method for using a pipe moving machine of the type having a pipe gripping jaw mounted on an elongate element, said method comprising the steps of:

using the jaw to grip a pipe joint which is horizontally disposed on a rack adjacent a well;

lifting the gripped pipe and positioning the same above a pipe string suspended in the well bore;

lowering the gripped pipe so that the lower end of the pipe contacts the top of the pipe string;

pivoting the upper end of the pipe about a pivot axis through the lower end of the pipe to align the pipe with the pipe string; and rotating the pipe joint to threadably connect it to the upper end of the pipe string.

12. Apparatus for moving pipe between a horizontal position adjacent a well to a position over the well bore, said apparatus comprising:

a base fixed adjacent the well;

a boom pivotally attached to said base for swinging toward and away from the well bore in a substantially vertical plane;

an elongate member pivotally attached to said boom;

a first clamp located adjacent one end of said elongate member for releasably clamping a pipe;

a second clamp located adjacent another end of said elongate member for releasably clamping the pipe;

a rotary actuator operatively connected between said boom and said elongate member for pivoting said elongate member during boom swinging; and a winch mounted on said elongate member and having a line connectable to one end of the pipe for moving the pipe to and from a position in which the pipe is gripped by said clamps.

13. A strongback comprising:

an elongated member;

gripping means mounted on said elongate member for releasably gripping a pipe;

a winch mounted on said elongate member and having a line connectable to one end of the pipe for moving the pipe to and from a position in which the pipe is gripped by said gripping means; and means attached to said elongate member for rotatingly mounting said strongback on a boom.

* * * * *